US005387010A

United States Patent [19]

Mohr

[11] Patent Number: 5,387,010

[45] Date of Patent: Feb. 7, 1995

[54] APPARATUS FOR SECURING LOOSELEAF PAGES TO A GOLF CART

[76] Inventor: Christopher G. Mohr, Rte. 1, Norwood, Ga. 30821

[21] Appl. No.: 125,419

[22] Filed: Sep. 22, 1993

[51] Int. Cl.[6] ..... B42D 17/00

[52] U.S. Cl. ..... 281/43; 281/45; 281/51; 402/4; 40/593; 280/DIG. 5; 224/274; 224/277; 108/44; D34/27

[58] Field of Search ..... 281/43, 45, 51; 402/4; 40/593, 642, 530; 280/DIG. 6, DIG. 5, 645, 33.992; 224/274, 277; 248/4417.1, 447.2, 441.1; 108/44, 45, 46, 143; D34/37

[56] References Cited

U.S. PATENT DOCUMENTS

| | | | |
|---|---|---|---|
| D. 176,627 | 1/1956 | Nash . | |
| 1,573,447 | 2/1926 | Prewitt . | |
| 1,629,291 | 5/1927 | Muscate | 224/277 X |
| 1,733,293 | 10/1929 | Brow | 224/277 X |
| 2,141,849 | 12/1938 | Baer | 248/447.2 |
| 2,201,789 | 5/1940 | Robilotto . | |
| 2,523,590 | 9/1950 | Potter et al. | 224/274 |
| 2,782,971 | 2/1957 | Hershey | 224/274 |
| 2,918,202 | 12/1959 | Constantine et al. | 248/447.2 X |
| 3,128,021 | 4/1964 | Habbena . | |
| 3,311,276 | 3/1967 | Fromm | 224/277 |
| 4,034,539 | 7/1977 | Economy | 281/45 X |
| 4,157,152 | 6/1979 | Blastic . | |
| 4,577,788 | 3/1986 | Richardson | 108/44 X |
| 4,995,637 | 2/1991 | Muraishi . | |
| 5,072,957 | 12/1991 | Graebe, Jr. | 280/33.992 |
| 5,083,736 | 1/1992 | McCoy . | |
| 5,086,960 | 2/1992 | Schwietzer | 224/277 |
| 5,094,451 | 3/1992 | Glamack | 283/116 X |
| 5,284,340 | 2/1994 | Laasko | 283/50 X |

*Primary Examiner*—Mark Rosenbaum
*Assistant Examiner*—Frances Han
*Attorney, Agent, or Firm*—Deveau, Colton & Marquis

[57] ABSTRACT

An apparatus for mounting to a golf cart for supporting and displaying looseleaf pages, in particular for displaying golf course information. The apparatus includes a base for supporting looseleaf pages at an oblique angle relative to the cowl of the golf cart. A binder is secured to the base for holding the looseleaf pages and a first attachment element is provided for securing the base to the cowl at the edge. A second attachment element is provided for also attaching the base to the cowl. In a second preferred form, the apparatus is configured for mounting to the steering column of the golf cart, rather than to the cowl itself.

6 Claims, 3 Drawing Sheets

APPARATUS FOR SECURING LOOSELEAF PAGES TO A GOLF CART

TECHNICAL FIELD

The present invention relates generally to sports equipment, and in particular relates to an accessory for use with a golf cart.

BACKGROUND OF THE INVENTION

In playing golf it can be quite helpful to know as much information about the hole to be played as possible. For example, it is helpful to know whether the hole involves any water which cannot be seen from the tee or some other hazard. Also, it is not always readily apparent whether the green is off to the left or to the right of a fairway when standing on the tee. Also, if there is a "dogleg", it can be helpful to know what the distance is to the dogleg in order to play with the appropriate club in order to drive the ball the correct distance in setting up the next shot. Thus, course information can be a great help to the golfer on the course.

Heretofore, it has been common to employ aids on golf carts for certain purposes. For example, some golf carts are equipped with a clipboard-like arrangement on the steering wheel for holding a score card and a pencil. Also, it is typical for carts to have a console which is adapted for holding golf balls and tees in convenient arrangements. Unfortunately, none of the known arrangements or accessories are convenient for securing looseleaf pages which might contain course information. Up until now, course information has been merely handed out as a pamphlet to a golfer, which can become lost or misplaced.

Accordingly, it can be seen that a need yet remains for an apparatus for securing looseleaf pages to a golf cart so that course information can be displayed in a convenient manner for a golfer. It is to the provision of such a device that the present invention is primarily directed.

SUMMARY OF THE INVENTION

Briefly described, in a first preferred form the present invention comprises an apparatus for mounting to a golf cart for supporting and displaying looseleaf pages, in particular for displaying course information. In one form, the invention is for use with golf carts of the type having a front cowl and a dash which forms an edge at the junction between the cowl and a dash. The device comprises a base for supporting the looseleaf pages at an oblique angle relative to the cowl. Binder means are secured to the base for holding the looseleaf pages. A first attachment means is provided for attaching the base to the cowl adjacent the edge and a second attachment means, distal from the first attachment means, also is provided for attaching the base to the cowl. Preferably, the first attachment means is in the form of a hook-like element for looping over the edge and the second attachment means is adapted to be easily releasably attached and detached from the cowl.

In a second preferred form the invention comprises a device for mounting to a golf cart for supporting and displaying looseleaf pages, the golf cart being of the type having a steering column. The device includes a base for supporting the looseleaf pages in an orientation wherein pages extend generally transversely of the steering column. A binder mechanism is mounted to the base for retaining the looseleaf pages. A first attachment element is positioned at one end of the base for securing the base to the steering column. A second attachment element secures the base to the steering column and is mounted to the base at a position generally opposite the first end of the base. Preferably, the attachment elements include semi-cylindrical mounting feet adapted to be mounted over and clamped to the steering column. Also, the base preferably defines a semi-circular opening for receiving the steering column therein adjacent one of the mounting feet.

With these arrangements, course information can be displayed in a convenient manner, which course information then is readily visible to the golfer in the cart as he travels to the next hole. This arrangement helps to avoid losing the pages and keeps the pages within easy reach of the golfer. By making the device easily mounted to the cart, the carts can be sold separately by the manufacturer and then the specific course information can be added by the golf club personnel after receiving the cart.

Accordingly, it is an object of the present invention to provide an apparatus for securing looseleaf pages to a golf cart which is simple in use, durable in construction, and economical in manufacture.

It is another object of the present invention to provide an apparatus for securing looseleaf pages to a golf cart which allows good visibility of course information contained on the looseleaf pages.

It is another object of the present invention to provide an apparatus for securing looseleaf pages to a golf cart which can be easily mounted on and removed from the golf cart.

These and other objects, features, and advantages of the present invention will become apparent upon reading the following specification in conjunction with the accompanying drawing figures.

BRIEF DESCRIPTION OF THE DRAWING FIGURES

DETAILED DESCRIPTION

Figure 1:
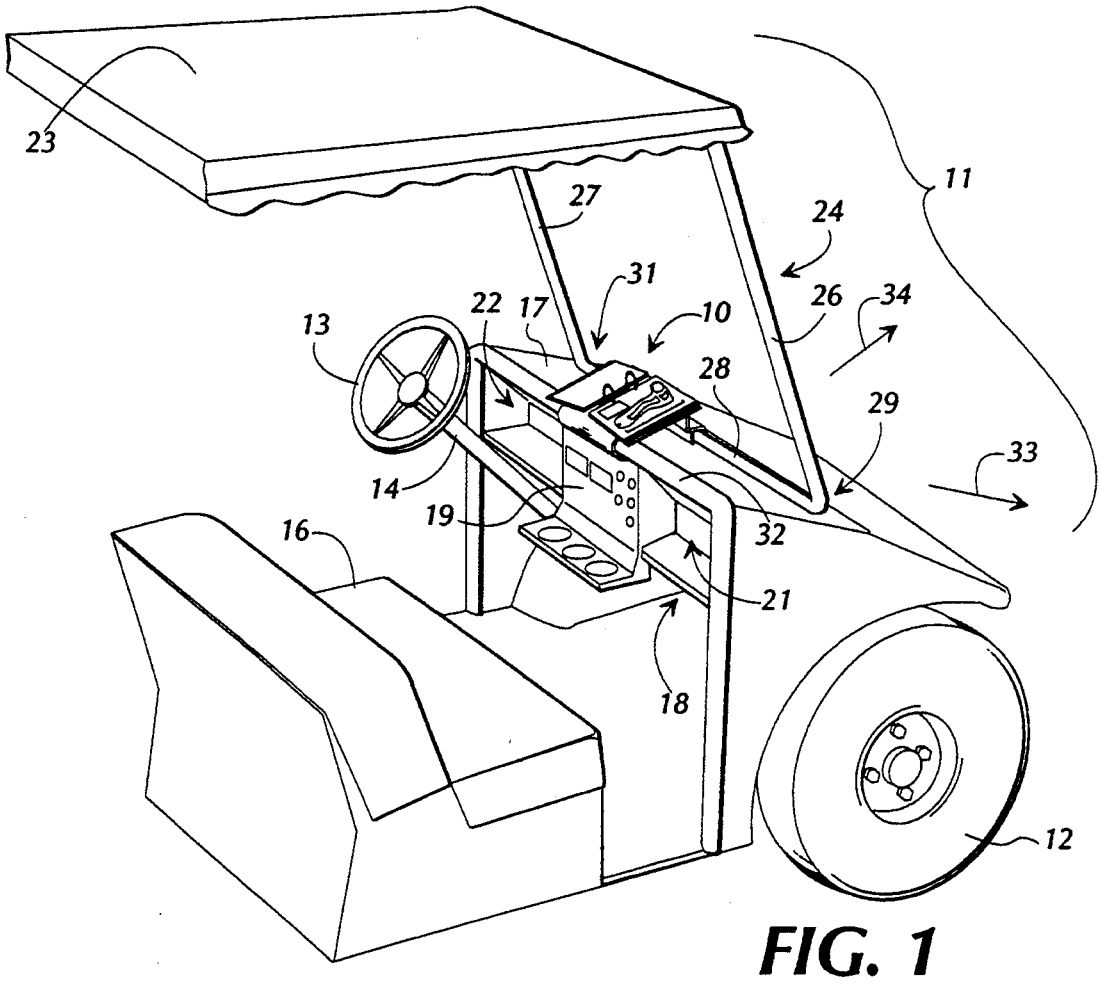
FIG. 1 is a perspective illustration of a portion of a golf cart showing a first preferred form of the invention mounted thereto.

Referring now in detail to the drawing figures, wherein like reference numerals represent like parts throughout the several views, FIG. 1 shows a device 10 for securing looseleaf pages to a golf cart, the golf cart generally indicated at 11. The golf cart illustrated is of the commercially available type including front wheels, such as wheel 12, a steering wheel 13, a steering column 14, a padded seat 16, a cowl 17, and a dash indicated generally at 18.

The golf cart 11 depicted in FIG. 1 is a commercially available unit from E-Z-Go of Augusta, Ga. and typically includes a center console 19 situated in the dash 18 and defining compartments 21 and 22 on either side thereof. The center console 19 is of the sort described in the "Background of the Invention" portion of the present application for holding golf balls and tees.

Many such golf carts include an upper canopy 23 to protect against sun and rain. The canopy 23 is supported over the golf cart by a support frame indicated at 24. Support frame 24 typically includes two upright stanchions 26 and 27 connected by a lower beam 28 and an unshown upper beam. Typically, the support frame 24 is made up of a unitary piece of square tubing which has been formed by bending at corners 29 and 31. The support frame 24 is secured to the cowl 17 by unshown bolts.

At a rear portion of the cowl 17, the cowl meets with the dash 18 along an upper edge. Typically, this edge is covered by a robber strip 32. The cowl drops away from horizontal from this edge along direction 33. The device 10 holds the looseleaf pages at an orientation 34 which is at an oblique angle relative to direction 33. That is to say that the cowl 17 lies in a plane containing direction arrow 33 and that the looseleaf pages are held in a plane containing direction arrow 34, with these two planes being oriented at an oblique angle relative to each other. The advantage of this is that this tends to orient the pages in a readable orientation for a golfer seated on the seat 16 of the cart 11.

Figure 2:
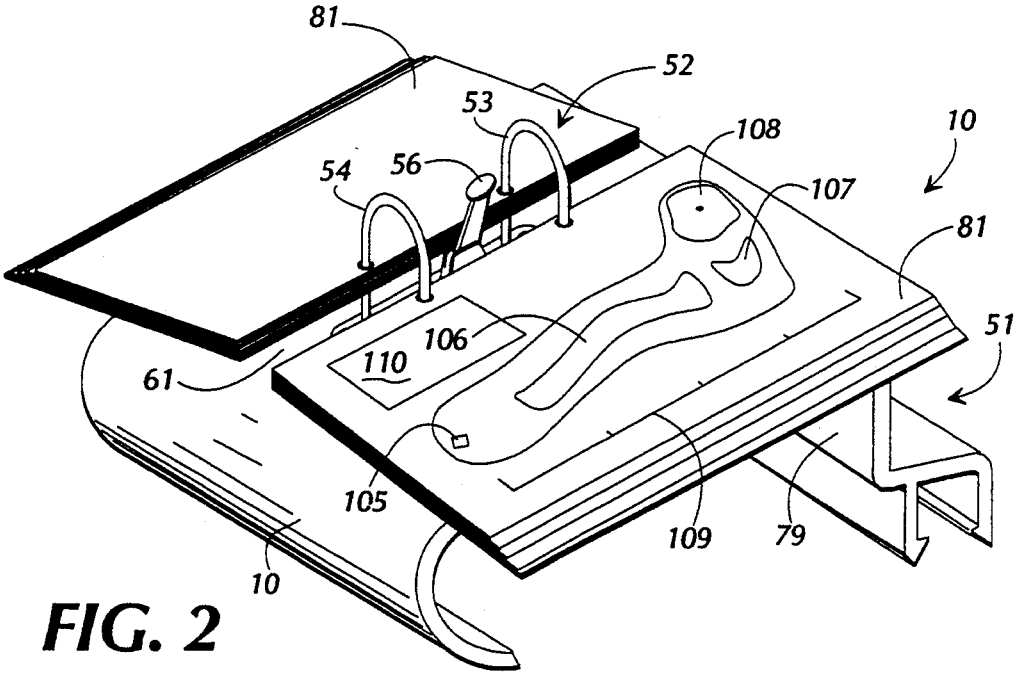
FIG. 2 is a perspective illustration of the device of FIG. 1.
Figure 3:
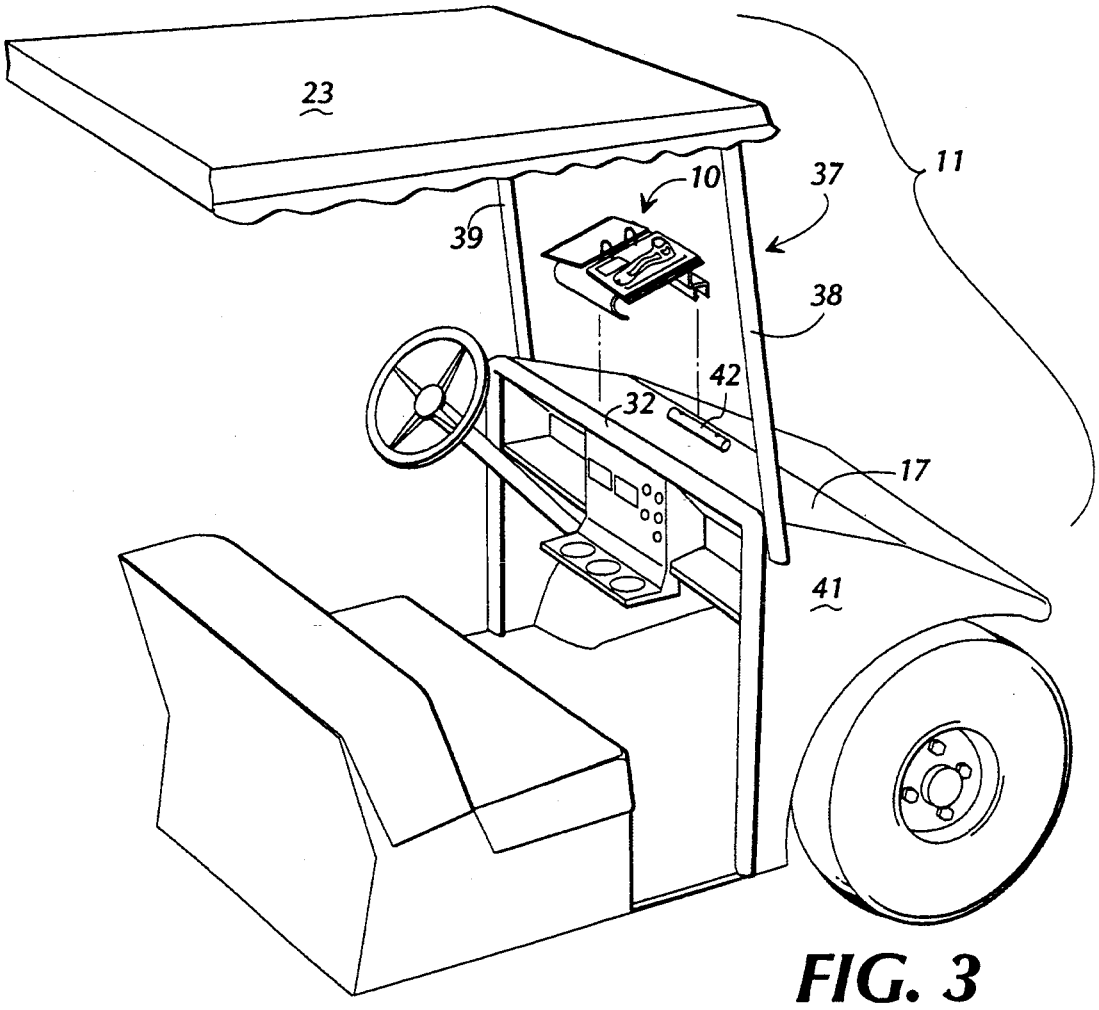
FIG. 3 is a perspective, partially exploded illustration of the golf cart and invention of FIG. 1.

FIG. 3 shows the device 10 for mounting to another type of commercially available golf cart 36 in which the support flame 37 includes two upright stanchion 38 and 39 which are bolted to the outsides of the fenders or side panels, such as fender 41. For this type of cart, the device 10 can be mounted to the cowl by providing a short section of tubing 42, be it square or round or some other cross-section. What is important here is that the tubing 42 be secured to the cowl 17 for receiving the device 10 in a manner described in connection with FIG. 1 previously and further as described regarding FIGS. 2 and 4 below.

Figure 4:
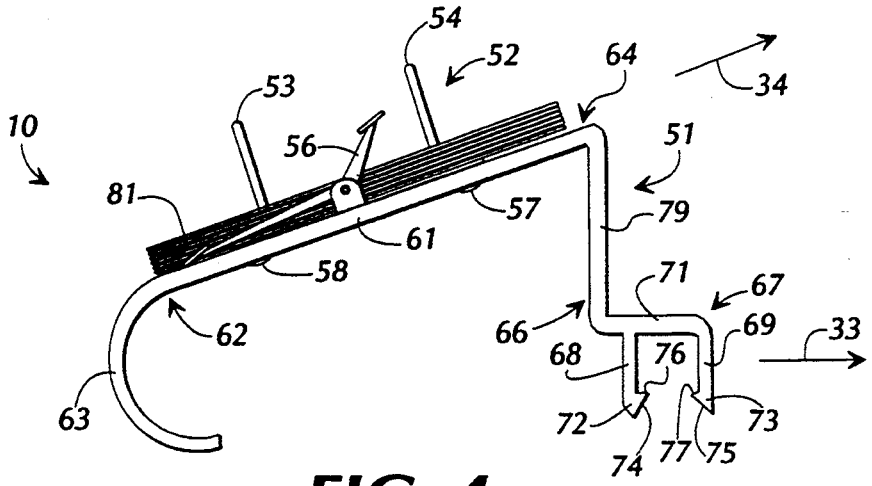
FIG. 4 is a schematic side elevation view of the device of FIG. 1.

Referring now to FIGS. 2 and 4 together, the details of the device 10 will be explained more fully. The device 10 includes a support frame indicated generally at 51 for mounting to the golf cart and a binder mechanism 52 mounted to the support frame 51. In the illustrative embodiment shown in the figures, the binder mechanism includes a pair of binder rings 53 and 54 which are operated by a lever 56. The binder mechanism 52 is secured to the support frame 51 by fasteners, such as rivets 57 and 58.

The support frame 51 preferably is made of a unitary construction from plastic or some other suitable material. What is important is that the material be rather weatherproof since the golf cart is used outside and in inclement whether as well. Thus, if steel is used, it preferably should be stainless steel. The support frame 51 includes a base portion 61 which is planar and to which is mounted the binder mechanism 52. Adjacent a first end 62 of the planar base portion 61 is a generally hook-shaped retaining element or attachment means 63. The curvature of the hook-shaped retaining member 63 can preferably be matched closely to that of the edge or rubber covering 32 covering the edge between the cowl 17 and the dash 18. Preferably, the hook-shaped retaining member 63 has some resiliency or springiness to it to allow it to have some give to aid in mounting and removing the device 10.

Adjacent a second end 64 of the planar base portion 61 is formed a second retaining member or attachment means indicated generally at 66. The second attachment means is generally distal from the first attachment means 63. The second attachment means 66 is made up of two portions, gripping member 67 and a riser portion 79. The gripping member 67 is adapted for releasably engaging a bar, such as tubing 42 or lower beam 28 secured to the cowl. Preferably, the gripping member 67 takes the form of a U-shaped channel (inverted) for receiving the lower beam 28 or tubing 42 therein. The U-shaped channel as depicted in FIGS. 2 and 4 includes a first leg or tine 68, a second leg or tine 69, and a bridge portion 71. At the ends of the legs, distal from the bridge portion 71, barbs 72 and 73 are formed. The barbs 72 and 73 include angled surfaces 74 and 75 for easing mounting of the device 10 over the tubing 42 or lower beam 28 and ledges 76 and 77 for securing the device in place. Similar to the hook-shaped retaining member 63, the legs 68 and 69 of the gripping member 67 should have some resiliency to facilitate mounting and removing of the device 10. The second attachment means also includes a riser portion or upright stanchion 79 which acts to space the planar base portion 61 a selected distance above the gripping member 67 at the second end 64. This causes the planar base portion 61 to assume an angled or inclined orientation relative to the hook-shaped retaining member 63 and the gripping member 67. When installed, the device then supports looseleaf pages 81 in a plane oriented along direction arrow 34 (see FIG. 4) which is oriented at an oblique angle relative to the plane of the cowl 17 as depicted by direction arrow 33.

Figure 5:
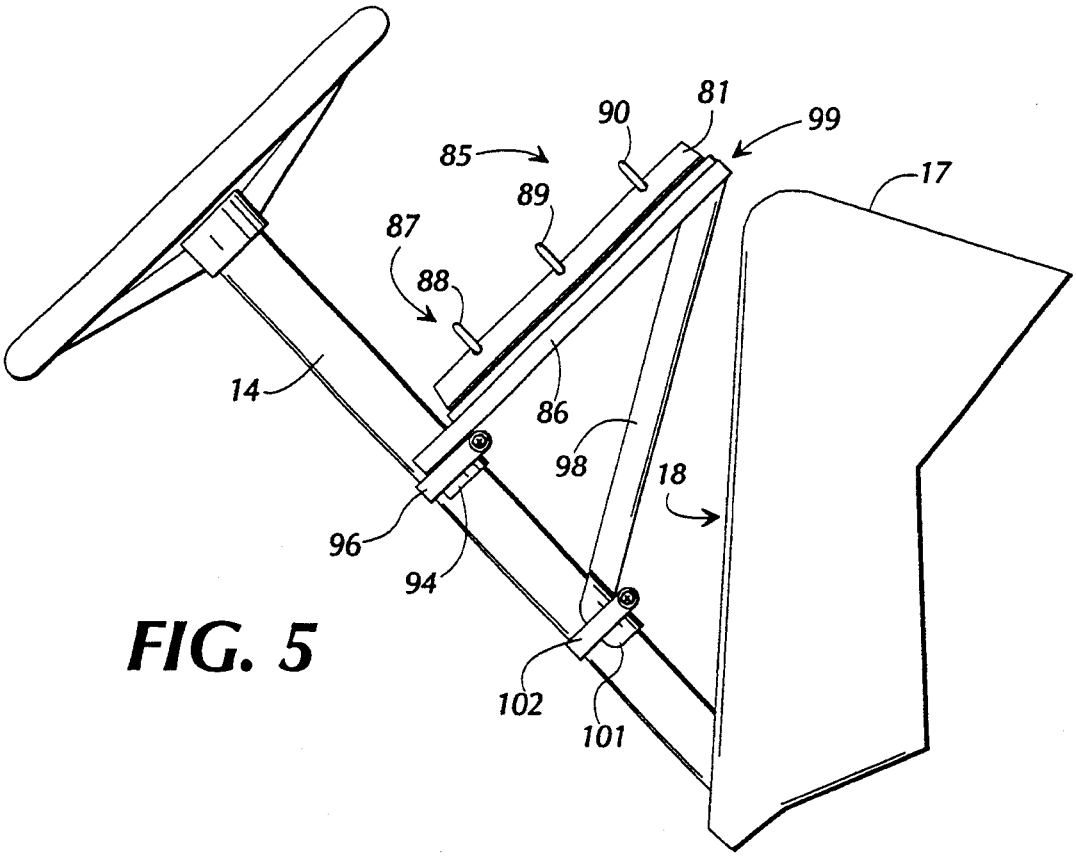
FIG. 5 is a schematic, side elevation view of a device according to a second preferred form of the invention shown mounted to a steering column portion of a golf cart.
Figure 6:
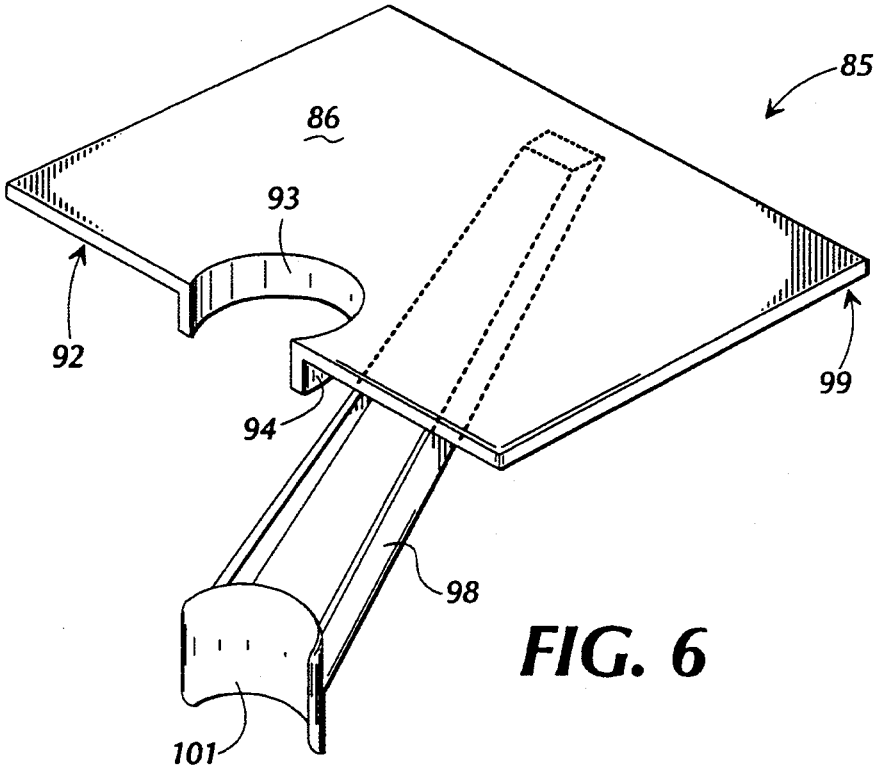
FIG. 6 is a schematic, perspective illustration of the device of FIG. 5.

Referring now to FIGS. 5 and 6, a second preferred form of the invention is considered. Some golf carts do not have any sort of beam or tubing extending across the top of the cowl or for some other reasons may not be well suited to using the device 10 according to the first form of the invention disclosed herein. In that situation, this second form of the invention can be helpful. Specifically, a device 85 is disclosed which can be mounted to a steering column 14 of the golf cart. In this embodiment, device 85 includes a base 86 for supporting a binder mechanism indicated generally at 87. In the specific illustrative embodiment depicted in FIG. 5, the binder mechanism comprises a conventional three-ring binder arrangement including binder rings 88, 89, and 90. The binder mechanism 87 is secured to the base 85 by conventional means, such as by unshown rivets.

The base portion 86 is generally planar as depicted in FIGS. 5 and 6 in the form of a rectangular member. Along one edge 92 of the planar base 86, a cut-out or opening is defined by a semi-cylindrical wall portion 93. The semi-cylindrical wall portion 93 thus defines a semi-circular opening or aperture in the base 86. At this opening, a lip extends below the lower surface of the base 86 to define a mounting foot 94. The mounting foot 94 is semi-cylindrical in shape and is adapted to be slipped over the steering column 14 so that the steering column is received within the opening defined by the semi-cylindrical wall 93. The semi-cylindrical mounting foot 94 can then be secured in place about the steering column 14 with the use of a clamp, such as hose clamp 96. The opening defined by the semi-cylindrical wall 93 together with the mounting foot 94 collectively operate as an attachment means for securing the base to the steering column.

A second attachment means for securing the base to the steering column is provided in the form of a strut 98. The strut 98 is elongated and extends from an edge portion 99 of the base 86 to the steering column. The strut 98 can be integrally formed with the base 86 or can be secured thereto by any suitable means, such as fasteners or welding or adhesives. The strut 98 is positioned at an inclined angle relative to the base 86 so as to maintain the base 86 at a generally perpendicular orientation with respect to the steering column 14. In ram, this supports the pages 81 secured by the binder mechanism 85 in an orientation extending generally transversely of the steering column 14, and preferably in an orientation which is perpendicular to the steering column 14. The strut 98 also includes a semi-cylindrical mounting foot 101 for placement against steering column 14 for mounting the strut to the steering column. With the mounting foot 101 placed against the steering column 14, the mounting foot can be secured in place by a second hose clamp 102.

Preferably, to minimize manufacturing costs and to enhance the weather-resistance of the device 85, the base 86 and the strut 98 are injection molded of a suitable plastic material. Of course, other constructions are possible.

With the arrangements disclosed herein according to the two preferred embodiments, it can be seen that the looseleaf pages can be mounted in a position and orientation which allows good visibility of course information contained on the looseleaf pages. Indeed, from FIG. 2, one can see how the course information can be laid out on the page showing a tee area 105, a fairway 106, a sand trap 107 and a green 108. Also, one can see that a distance legend 109 can be provided as well as a space for advertising 110.

The arrangements according to the preferred embodiments disclosed herein are simple in use, durable in their construction, and are economical in manufacture. Also, these devices are easily mounted on and removed from the golf cart. These arrangements help to keep the pages within the easy reach of the golfer and, since they are easily removed, can be added by the golf club personnel after purchasing the golf cart. Likewise, the present invention allows golf club personnel to change the information on the pages as the need arises, such as for tournaments or other special events.

While the invention has been disclosed in preferred forms only, it will be readily apparent to those skilled in the art that many modifications, additions, and deletions may be made therein. For example, it will be apparent to those skilled in the art that the present invention has direct application to golf carts made by other manufacturers, such as Club Car of Augusta, Ga. and Yamaha. These and other additions, deletions, and modifications nevertheless fall within the scope and spirit of the invention as defined by the appended claims.

What is claimed is:

1. A device for mounting to a golf cart for supporting and displaying looseleaf pages, the golf cart of the type having a front cowl and a dash with an edge formed at a junction of the cowl and the dash, said device comprising:

a base for supporting the looseleaf pages at an oblique angle relative to the cowl;

ring binder means secured to said base for holding the looseleaf pages;

a first attachment means for attaching said base to the cowl adjacent the edge, said first attachment means comprising a hook-like member to be hooked over the edge; and a second attachment means, distal from said first attachment means, for attaching said base to the cowl.

2. A device as claimed in claim 1 wherein said second attachment means comprises a gripping member for releasably engaging a bar secured to the front cowl of the golf cart.

3. A device as claimed in claim 2 wherein said gripping member comprises at least one barb-like portion for releasably engaging the bar.

4. A device as claimed in claim 2 wherein said gripping member is elongate and generally U-shaped in cross-section.

5. A device as claimed in claim 4 wherein said U-shaped gripping member includes first and second tines each having tapered surfaces for easing said gripping member over the bar and ledges for releasably retaining said gripping member positioned over the bar.

6. A device as claimed in claim 1 wherein said hook-like member is made from a resilient material for conformably engaging the edge formed at the junction of the cowl and the dash.

* * * * *